US011466873B2

(12) United States Patent
Seo et al.

(10) Patent No.: US 11,466,873 B2
(45) Date of Patent: Oct. 11, 2022

(54) AIR CONDITIONER

(71) Applicant: Samsung Electronics Co., Ltd, Suwon-si (KR)

(72) Inventors: Yong Ho Seo, Suwon-si (KR); Min Gi Cho, Suwon-si (KR); Woo Seog Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 461 days.

(21) Appl. No.: 16/593,913

(22) Filed: Oct. 4, 2019

(65) Prior Publication Data

US 2020/0109868 A1 Apr. 9, 2020

(30) Foreign Application Priority Data

Oct. 5, 2018 (KR) ..... 10-2018-0119176

(51) Int. Cl.
*F28F 19/00* (2006.01)
*F24F 1/56* (2011.01)
*F24F 13/08* (2006.01)

(52) U.S. Cl.
CPC ..... *F24F 1/56* (2013.01); *F24F 13/082* (2013.01)

(58) Field of Classification Search
CPC ... F24F 1/56; F24F 1/38; F24F 13/082; F04D 29/703
USPC ..... 416/247 R
See application file for complete search history.

(56) References Cited

U.S. PATENT DOCUMENTS

| | | | | |
|---|---|---|---|---|
| 7,172,387 | B2 | 2/2007 | Yamamoto et al. | |
| 2005/0238481 | A1* | 10/2005 | Yamamoto | F24F 1/50 415/121.2 |
| 2007/0116559 | A1* | 5/2007 | Higashida | F24F 1/0047 415/206 |
| 2019/0030992 | A1* | 1/2019 | Tada | F25B 30/02 |

FOREIGN PATENT DOCUMENTS

| | | | |
|---|---|---|---|
| EP | 1357337 | A1 | 10/2003 |
| JP | H-10197014 | A | 7/1998 |
| JP | 11-230568 | A | 8/1999 |
| JP | 2000088277 | A | 3/2000 |

(Continued)

OTHER PUBLICATIONS

Pdf attached is translation of foreign reference WO 2014017188 A1 (Year: 2014).*

(Continued)

*Primary Examiner* — Len Tran
*Assistant Examiner* — Kamran Tavakoldavani

(57) ABSTRACT

An air conditioner according to the disclosure includes a blowing fan including a suction port, a bell mouth formed along a circumferential direction of the suction port, and a fan guard extending from an inner circumferential surface of the bell mouth and covering the suction port, wherein the fan guard includes a plurality of annular ribs arranged concentrically with a gap from a center of the fan guard corresponding to a rotation axis of the blowing fan, the plurality of annular ribs includes a first annular rib adjacent the outermost edge of the fan guard and the first annular rib is arranged to be inclined to the rotation axis in a direction corresponding to the tangent line of the bell mouth.

18 Claims, 12 Drawing Sheets

(56) References Cited

FOREIGN PATENT DOCUMENTS

| | | | | |
|---|---|---|---|---|
| JP | 3227552 | B2 | 11/2001 | |
| JP | 2003-172528 | A | 6/2003 | |
| JP | 2004-156884 | A | 6/2004 | |
| KR | 100329928 | B1 | 3/2002 | |
| KR | 100642363 | B1 | 10/2006 | |
| KR | 20090001193 | U | 2/2009 | |
| KR | 20090001590 | U | 2/2009 | |
| KR | 10-2012-0049692 | A | 5/2012 | |
| KR | 20-0461854 | Y1 | 8/2012 | |
| WO | 2004068039 | A1 | 8/2004 | |
| WO | WO-2004068039 | A1 * | 8/2004 | ..... F04D 29/542 |
| WO | 2014017188 | A1 | 1/2014 | |
| WO | WO-2014017188 | A1 * | 1/2014 | ..... F04D 29/703 |

OTHER PUBLICATIONS

Attached pdf is translation of foreign reference (Year: 2004).*
Supplementary European Search Report dated Sep. 13, 2021, in connection with European Patent Application Mo. 19869695.7, 8 pages.
International Search Report dated Jan. 29, 2020 in connection with International Patent Application No. PCT/KR2019/013044, 3 pages.

* cited by examiner

AIR CONDITIONER

CROSS-REFERENCE TO RELATED APPLICATION

This application is based on and claims priority under 35 U.S.C. § 119 to Korean Patent Application No. 10-2018-0119176 filed on Oct. 5, 2018 in the Korean Intellectual Property Office, the disclosure of which is incorporated by reference herein in its entirety.

BACKGROUND

1. Field

The disclosure relates to an air conditioner, and more particularly, to a fan guard of a blowing fan.

2. Description of Related Art

Generally, the air conditioner is a device that removes dust and the like in the air while controlling temperature, humidity, air flow and the like to be suitable for human activity by using a refrigeration cycle. The refrigeration cycle includes a compressor, a condenser, an evaporator, an expansion valve, and a blowing fan as main components.

The air conditioner may be classified into a split type air conditioner in which an indoor unit and an outdoor unit are separately installed and an integrated type air conditioner in which an indoor unit and an outdoor unit are installed together in a single cabinet.

Among them, the indoor unit of the split type air conditioner includes a heat exchanger configured to heat exchange the air sucked into the panel, and a blowing fan configured to suck room air into the panel and blow the sucked air back into the room.

The air conditioner may further include a fan guard arranged on a suction port side of the blowing fan for preventing blades of the blowing fan from being exposed to the outside and injuring the user.

SUMMARY

One aspect of the disclosure provides an air conditioner having an enhanced shape of fan guard to increase air blowing efficiency.

In accordance with an aspect of the disclosure, the air conditioner comprises a blowing fan including a suction port;

a bell mouth formed along a circumferential direction of the suction port; and a fan guard extending from an inner circumferential surface of the bell mouth and covering the suction port; wherein the fan guard comprises a plurality of annular ribs concentrically arranged with a gap from a center of the fan guard corresponding to a rotation axis of the blowing fan, wherein the plurality of annular ribs comprises a first annular rib adjacent to an outermost edge of the fan guard and a second annular rib arranged further inside than the first annular rib in the radial direction of the fan guard, wherein the first annular rib is arranged to be inclined to the direction of the rotation axis in a direction corresponding to a tangent line of the bell mouth, and wherein a gap between the first annular rib and the second annular rib is set to be narrower than a gap between any annular ribs arranged adjacent to the center of the fan guard.

Some of the plurality of annular ribs, arranged in a first region adjacent to the bell mouth and including the first annular rib and the second annular rib may arranged to be inclined to the direction of the rotation axis, and some others of the plurality of annular ribs, arranged in a second region adjacent to the center of the fan guard may arranged to correspond to the direction of the rotation axis.

Assuming that a radius from the center of the fan guard is R, the first region may arranged outside a circle with radius R*0.6 in the radial direction of the fan guard.

The plurality of annular ribs may further comprise a second annular rib arranged further inside than the first annular rib in the radial direction of the fan guard, and an inclination angle of the first annular rib to the rotation axis is set to be larger than an inclination angle of the second annular rib to the rotation axis.

The plurality of annular ribs may further comprise a third annular rib arranged further inside than the second annular rib in the radial direction of the fan guard, and the inclination angle of the first annular rib to the rotation axis, the inclination angle of the second annular rib to the rotation axis, and an inclination angle of the third annular rib to the rotation axis are set to be gradually smaller.

Assuming that the inclination angle of the first annular rib is $\theta 1$ and the inclination angle of the second annular rib is $\theta 2$, the inclination angle ($\theta 2$) of the second annular rib may set to satisfy $0.5*\theta 1 \leq \theta 2 \leq 0.95*\theta 1$.

Assuming that an inclination angle between a tangent line an inner circumferential surface of a bell mouth at a point in a line passing the first annular rib in a radial direction of the fan guard and the rotation axis is $\theta 0$ and an inclination angle of the first annular rib to the rotation axis is $\theta 1$, the inclination angle $\theta 1$ of the first annular rib may set to satisfy $\theta 0-20° \leq \theta 1 \leq \theta 0+20°$.

The first region is formed to be inclined to the front of the suction port with respect to the rotation axis, and the second region extends from the first region and is formed to be orthogonal to the rotation axis in front of the suction port.

The first annular rib may comprise a plurality of protruding ribs projecting radially from at least one of an outer circumferential surface and an inner circumferential surface of the first annular rib.

The second annular rib may comprise a plurality of protruding ribs projecting radially on at least one of an outer circumferential surface and an inner circumferential surface of the second annular rib.

In the plurality of annular ribs, assuming that thickness of each of the plurality of annular ribs in the radial direction of the fan guard is t and height of each of the plurality of annular ribs in the rotating axis is h, the height of each of the plurality of annular ribs may set to satisfy $h \leq 10t$.

In the plurality of protruding ribs, assuming that thickness of each of the plurality of protruding ribs in the circumferential direction of the fan guard is a, the thickness of each of the plurality of protruding ribs may provided to satisfy 1 mm≤a≤5 mm.

In the plurality of protruding ribs, assuming that height of each of the plurality of protruding ribs in the radial direction of the fan guard is b, the height of each of the plurality of protruding ribs may set to satisfy 1 mm≤b≤10 mm.

Assuming that diameter of an inscribed circle contacting between the inner circumferential surface of the first annular rib and any two of the plurality of protruding ribs of the second annular rib is D, the diameter D of the inscribed circle is set to satisfy 5.6 mm≤D≤8.6 mm.

The blowing fan may comprise a sirocco fan.

In accordance with an aspect of the disclosure, the air conditioner comprises a housing having a first suction port and a second suction port; a first discharge port disposed in the housing to discharge air introduced through the first suction port; a second discharge port disposed in the housing to discharge the air introduced through the second suction port; a first flow path connecting the first suction port and the first discharge port; a second flow path connecting the second suction port and the second discharge port and being partitioned from the first flow path; a heat exchanger disposed on the first flow path; a partition portion for partitioning the first flow path and the second flow path; and an intermediate member having a guide portion for guiding the air on the first flow path to the first discharge port, wherein the first flow path is formed by the guide portion and the partition portion, and the second flow path is formed by the inside of the partition portion and the side surface of the housing.

The air conditioner further includes a first blowing fan which is disposed inwardly in the circumferential direction of the inner circumferential surface of the guide portion and configured to flow the air on the first flow path, and a second blowing fan which is disposed on the lower side of the intermediate member and configured to flow the air on the second flow path, wherein the first blowing fan blows air on the first flow path from the rear side to the front side and the second blowing fan blows air on the second flow path from the lower side to the upper side.

The partition portion extends from the guide portion to the inside of the side of the housing, and a side end of the partition portion is provided to be in contact with the inside of the side of the housing so that the first flow path and the second flow path are separated from each other.

The first discharge port is arranged to discharge heat-exchanged air, and the second discharge port is arranged to discharge air that has not been heat-exchanged.

In accordance with an aspect of the disclosure, the air conditioner comprises a blowing fan include a suction port; a bell mouth formed along a circumferential direction of the suction port; and a fan guard extending from an inner circumferential surface of the bell mouth and covering the suction port; wherein the fan guard comprises a plurality of annular ribs concentrically arranged with a gap from a center of the fan guard corresponding to a rotation axis of the blowing fan, wherein some of the plurality of annular ribs arranged in a first region adjacent to the bell mouth are arranged to be inclined to the rotation axis, and some others of the plurality of annular ribs arranged in a second region adjacent to the center are arranged to correspond to the rotation axis, and wherein a gap between some of the annular ribs arranged in the first region is narrower than a gap between some other annular ribs arranged in the second region.

An inclined angle of each of the annular ribs arranged in the first region adjacent to the bell mouth to the rotation axis may set to become smaller as the annular rib is arranged further inside in the radial direction of the fan guard.

The plurality of annular ribs may comprise a first annular rib adjacent an outermost edge of the fan guard and a second annular rib arranged further inside than the first annular rib in the radial direction of the fan guard, and assuming that an inclination angle of the first annular rib is θ1 and an inclination angle of the second annular rib is θ2, the inclination angle θ2 of the second annular rib is set to satisfy $0.5*\theta1 \leq \theta2 \leq 0.95*\theta1$.

Assuming that an inclination angle between a tangent line an inner circumferential surface of a bell mouth at a point in a line passing the first annular rib in a radial direction of the fan guard and the rotation axis is θ0 and an inclination angle of the first annular rib to the rotation axis is θ1, the inclination angle θ1 of the first annular rib may set to satisfy $\theta0-20° \leq \theta1 \leq \theta0+20°$.

In accordance with an aspect of the disclosure, the air conditioner comprises a blowing fan including a suction port; a bell mouth formed along a circumferential direction of the suction port; and a fan guard extending from an inner circumferential surface of the bell mouth and covering the suction port, wherein the fan guard comprises a plurality of annular ribs concentrically arranged with a gap from a center of the fan guard corresponding to a rotation axis of the blowing fan, wherein the plurality of annular ribs are divided into a first group of annular ribs arranged in a first region adjacent to the bell mouth and a second group of annular ribs arranged in a second region adjacent to the center, and wherein at least some of the annular ribs in the first group comprise a plurality of protruding ribs projecting radially from at least one of an outer circumferential surface or an inner circumferential surface of the partial annular rib.

According to embodiments of the disclosure, a fan guard of a blowing fan does not hinder the flow of air flowing into the blowing fan, thereby lowering noise of the air conditioner, increasing the blowing efficiency, and preventing safety accident of users.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
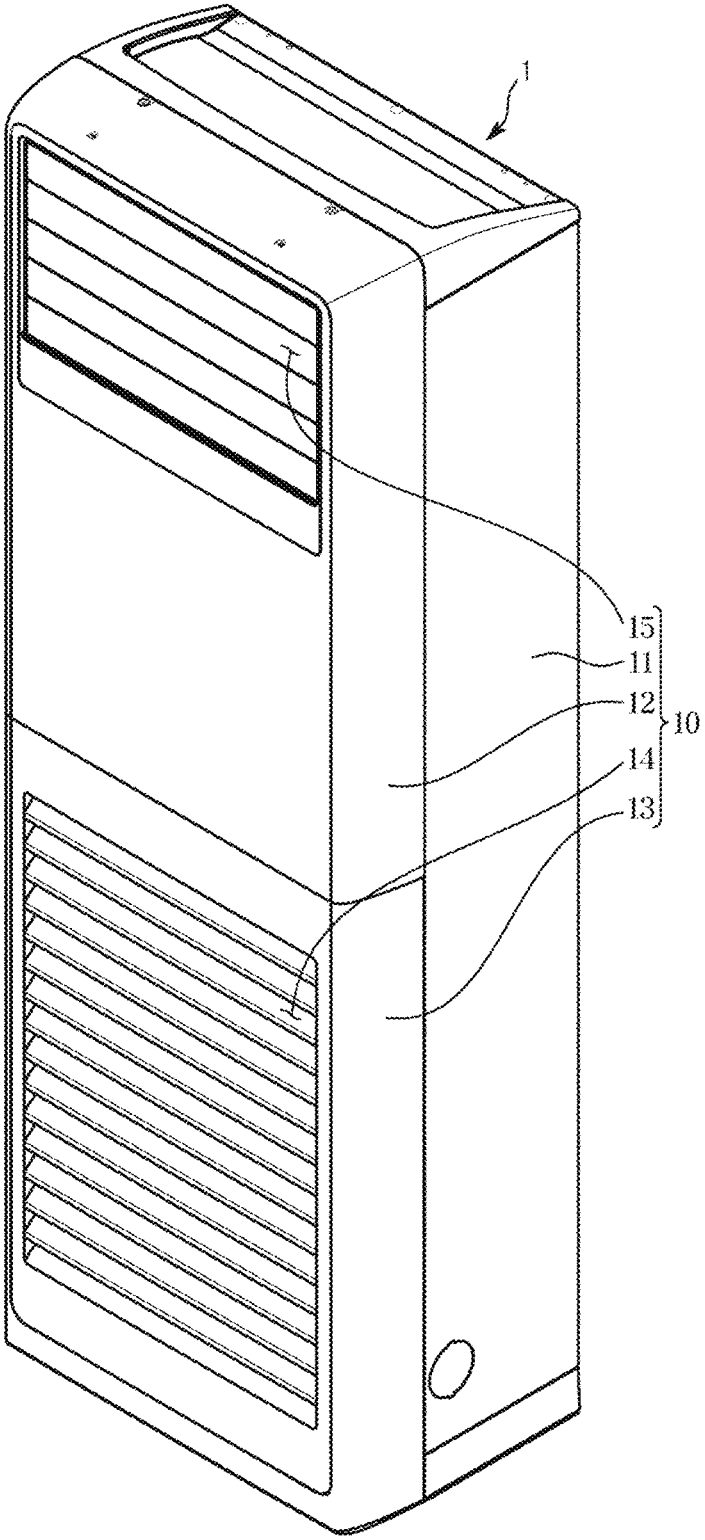
FIG. 1 illustrates a perspective view of an air conditioner according to an embodiment of the disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the specification and structures described in drawings are merely examples of the disclosure, and at the time of the application of the disclosure, various modifications and alternative forms to replace the embodiments and drawings may be made without departing from the scope of the disclosure.

Also, like reference numerals or symbols denoted in the drawings of the specification represent members or components that perform the substantially same functions.

Also, terms used in the disclosure are only used to describe particular embodiments, and it is not intended to limit the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined based on the drawings, but the terms may not restrict the shape and position of the respective component.

A refrigeration cycle for air conditioners includes a compressor, a condenser, an expansion valve, and an evaporator. The refrigeration cycle may circulate a series of processes including compression-condensation-expansion-evaporation, and may supply conditioned air that is heat exchanged with the refrigerant.

The compressor compresses and discharges the refrigerant gas in a state of high temperature and high pressure, and the discharged refrigerant gas flows into the condenser. The condenser condenses the compressed refrigerant into a liquid phase and releases heat to the surroundings through the condensation process.

The expansion valve expands the liquid refrigerant in the high-temperature and high-pressure state condensed in the condenser to the liquid refrigerant in the low-pressure state. The evaporator evaporates the refrigerant expanded in the expansion valve and returns the low-temperature low-pressure refrigerant gas to the compressor.

The evaporator may attain a freezing effect by heat exchange with an object to be cooled by using latent heat of evaporation of the refrigerant. Through this cycle, the air conditioner may control the temperature of indoor space.

The outdoor unit of the air conditioner refers to a part composed of a compressor of the cooling cycle and an outdoor heat exchanger. The indoor unit of the air conditioner may include an indoor heat exchanger, and the expansion valve may be located either in the indoor unit or the outdoor unit. The indoor heat exchanger and the outdoor heat exchanger serve as a condenser or an evaporator. When the indoor heat exchanger is used as a condenser, the air conditioner becomes a heater, and when the indoor heat exchanger is used as an evaporator, the air conditioner becomes a cooler.

Hereinafter, embodiments according to the disclosure will be described in detail with reference to the accompanying drawings.

Figure 2:
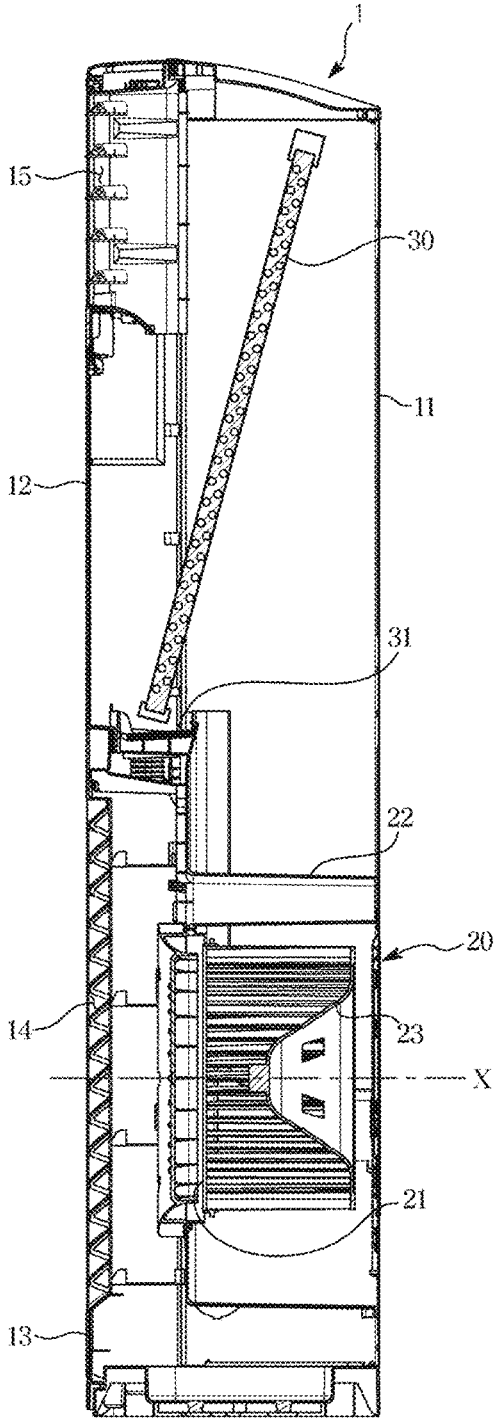
FIG. 2 illustrates a side cross-sectional view of the air conditioner shown in FIG. 1.
Figure 3:
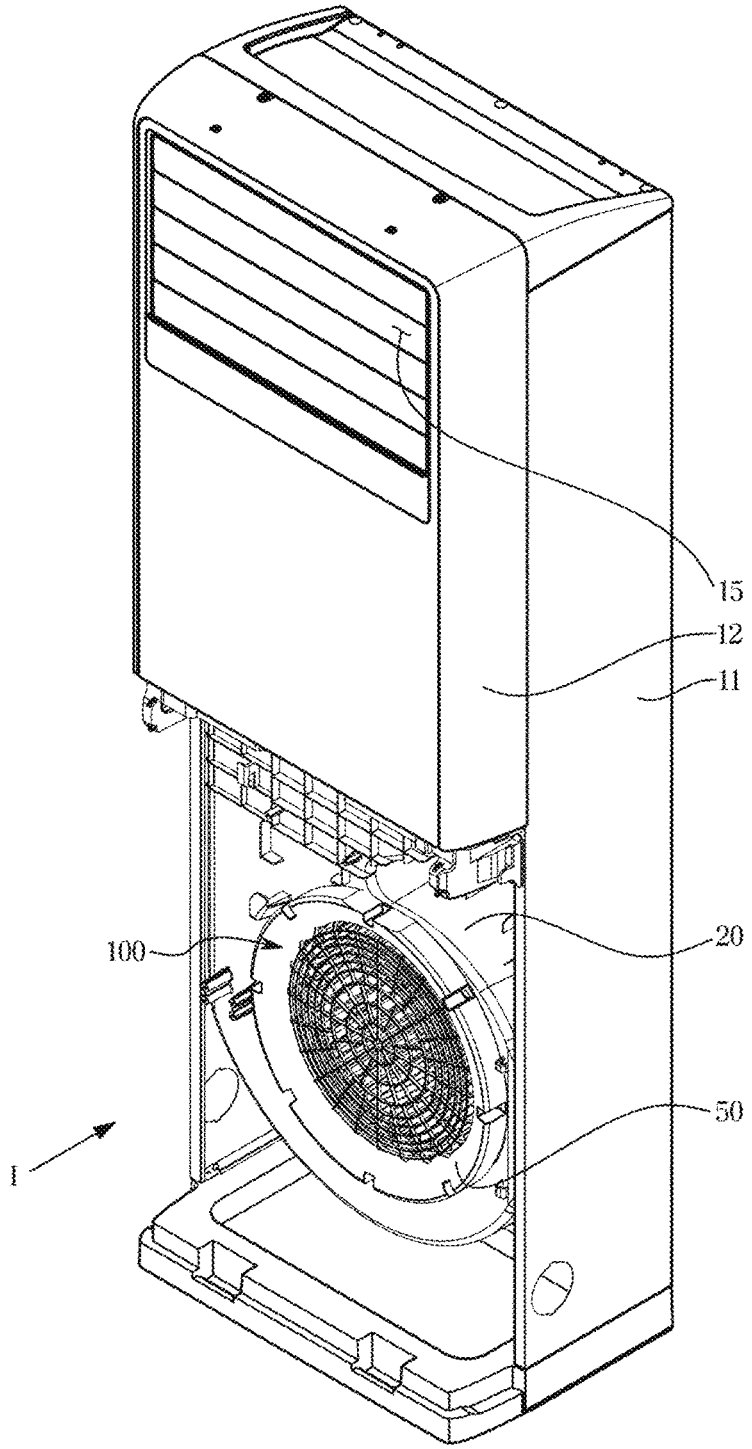
FIG. 3 illustrates a perspective view of the air conditioner of FIG. 1 with some components removed therefrom.

FIG. 1 illustrates a perspective view of an air conditioner according to an embodiment of the disclosure, FIG. 2 illustrates a side cross-sectional view of the air conditioner shown in FIG. 1, and FIG. 3 illustrates a perspective view of the air conditioner shown in FIG. 1 with some parts removed therefrom.

Referring to FIGS. 1 to 3, the air conditioner 1 comprises a housing 10 that forms an external appearance, a blowing fan 20 for circulating air to the inside or outside of the housing 10, and a heat exchanger 30 for exchanging heat with air flowing into the housing 10.

The housing 10 comprises a main body housing 11 provided with the blowing fan 20 and the heat exchanger 30, and a front upper frame 12 and a front lower frame 13 arranged on the front of the main body housing 11.

The housing 10 may include a suction port 14 arranged at the front lower frame 13 and a discharge port 15 arranged at the front upper frame 12.

A drain member 31 for collecting condensate water generated from the heat exchanger 30 may be arranged at the lower end of the heat exchanger 30.

The main body housing 11 may form a rear surface, a part of both side surfaces, a part of the upper surface and a bottom surface of the air conditioner 1. The front of the main body housing 11 is opened, and the front upper frame 12 and the front lower frame 13 may be arranged on the opened front.

The front upper frame 12 and the front lower frame 13 are shown to be provided to be detachable from the main body housing 11, but the front upper frame 12, the front lower frame 13, and the main body housing 11 may be integrally formed.

The discharge port 15 may be formed at the front upper frame 12. The discharge port 15 may be arranged on the front of the housing 10. The air that has exchanged heat inside the housing 10 may be discharged to the outside of the housing 10 through the discharge port 15. The discharge port 15 may discharge the air that has flown in through the suction port 14.

The blowing fan 20 is provided to move the air flowing in from the suction port 14 to the side of the heat exchanger 30. The blowing fan 20 may be provided in various forms, but in the embodiment of the disclosure, the blowing fan 20 may be formed as a sirocco fan.

The blowing fan 20 may include an inlet 21 including an opening opened to the front and provided to allow the air flowing into the housing 10 through the suction port 14 to flow into the blowing fan 20.

The blowing fan 20 may include an outlet 22 including an opening opened upward and provided to force the air to flow to the side of the heat exchanger 30. Blades 23 are provided between the inlet 21 and the outlet 22 for moving air by rotation.

The inlet 21 may be arranged so that the opening faces forward and is opposite the suction port 14. The opening of the inlet 21 may have a circular shape.

A bell mouth 50 provided to guide the air flowing into the blowing fan 20 may be arranged in front of the inlet 21. The bell mouth 50 has an annular shape and may include a curved inner circumferential surface 51.

A fan guard 100 may be radially arranged inside of the inner circumferential surface 51 of the bell mouth 50. As shown in the drawings, the fan guard 100 and the bell mouth 50 may be integrally formed. However, the bell mouth 50 and the fan guard 100 are not limited thereto and may be provided to be separable from each other.

The fan guard 100 may extend from the inner circumferential surface 51 of the bell mouth 50 and cover the opening of the inlet 21 of the blowing fan 20.

The fan guard 100 may include a plurality of annular ribs 110 concentrically arranged with a gap from one another from the center C of the fan guard 100 corresponding to rotational axis X of the blowing fan 20.

The fan guard 100 restricts contact of the users body with the blades 23 of the blowing fan 20, thereby securing safety of the user. For example, as shown in FIG. 3, when the front lower frame 13 is removed, the blowing fan 20 may be exposed to the outside, in which case, the fan guard 100 may prevent the users body from entering into the blowing fan 20 through the opening of the inlet 21.

By setting the gap between the plurality of annular ribs 110 to be substantially smaller than the size of the users finger, entering of a finger of the user, especially of a finger of a child into the inlet 21 may be prevented.

A conventional fan guard has a problem with low blowing efficiency or unnecessary noise as the fan guard arranged in front of the inlet restricts the flow of air flowing into the blowing fan.

In particular, when the blowing fan is formed as a sirocco fan as in the embodiment of the disclosure, the blades 23 of the sirocco fan have an annular shape, so that a large amount of air flows in through the inner circumferential surface of the bell mouth.

Accordingly, the fan guard formed on the side of the inner circumferential surface of the bell mouth may disturb the flow of the incoming air and collide with the air thereby making lots of noise.

In order to solve this problem, when the distance between the annular ribs of the fan guard arranged on the side of the inner circumferential surface of the bell mouth is designed to be long, there is a risk that the users finger or the like might collide with the blades 23 through the annular ribs.

Accordingly, the distance between the plurality of annular ribs may not be designed to be longer than a predetermined distance, which may inevitably cause low blowing efficiency and noise due to frictions with the incoming air In an embodiment of the disclosure, the fan guard 100 of the air conditioner 1 has the plurality of annular ribs 110 formed in consideration of the flow of incoming air, thereby minimizing friction between the air and the plurality of annular ribs 110, leading to a decrease in noise and an increase in blowing efficiency.

Hereinafter, the specific structure of the fan guard 100 will be described in detail.

Figure 4:
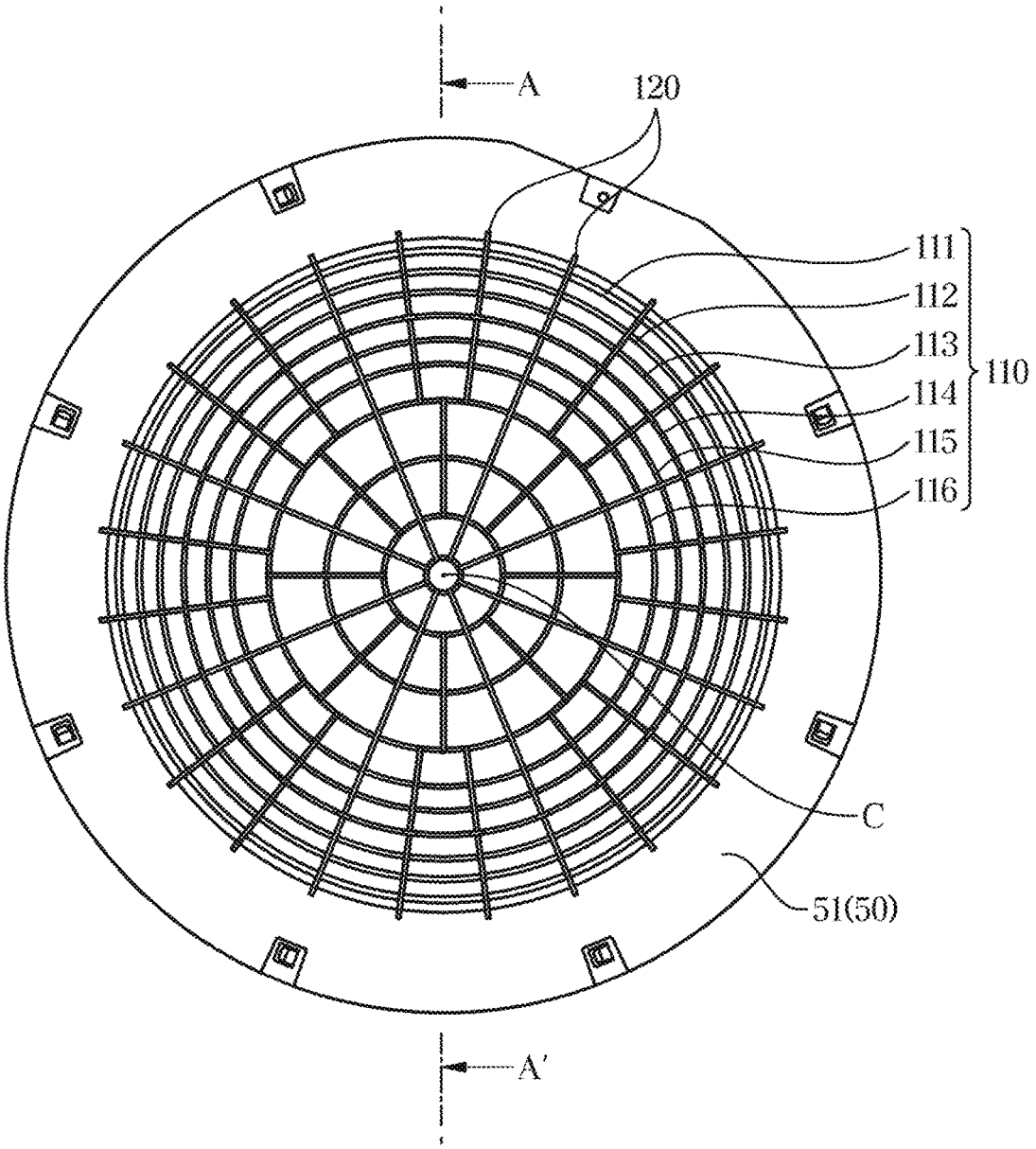
FIG. 4 illustrates a front view of a fan guard and a bell mouth of the air conditioner shown in FIG. 1
Figure 5:
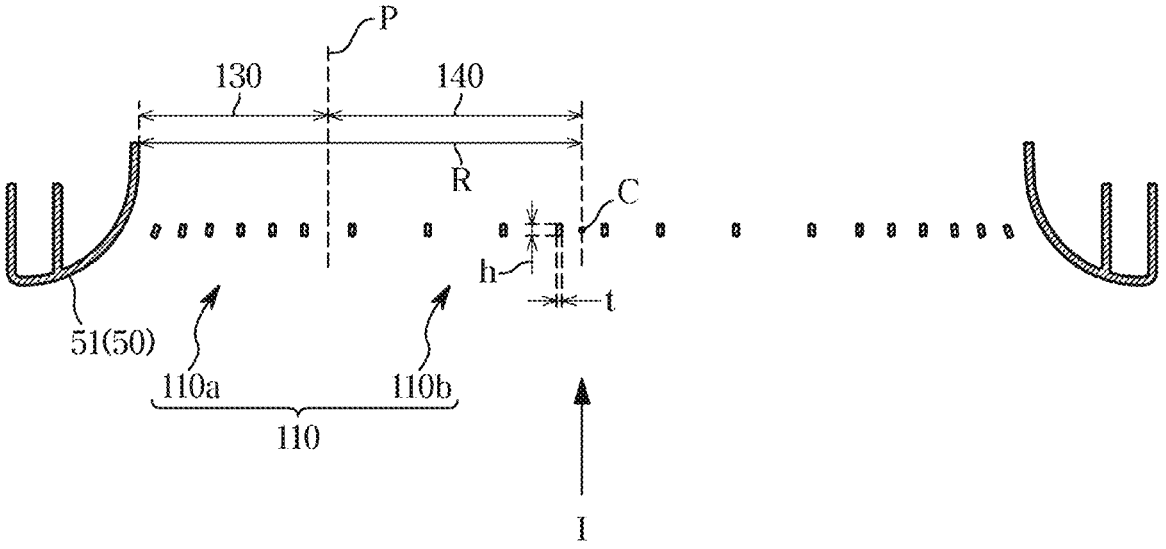
FIG. 5 illustrates a cross-sectional view taken along the line A-A shown in FIG. 4.
Figure 6:
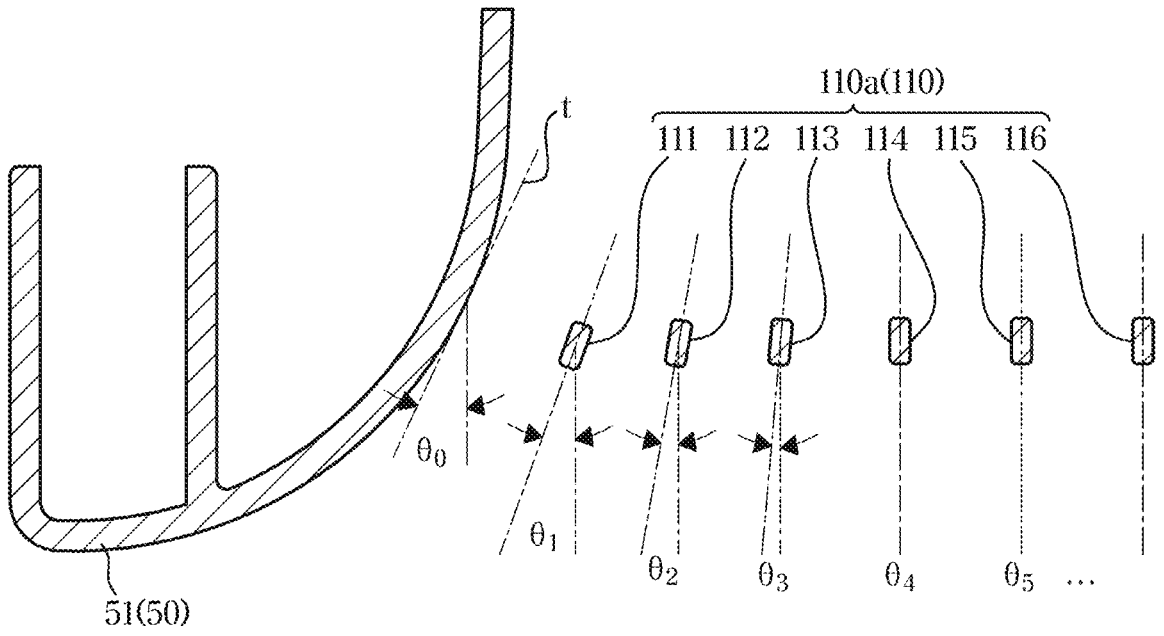
FIG. 6 illustrates a cross-sectional view of the fan guard and bell mouth shown in FIG. 5.
Figure 7:
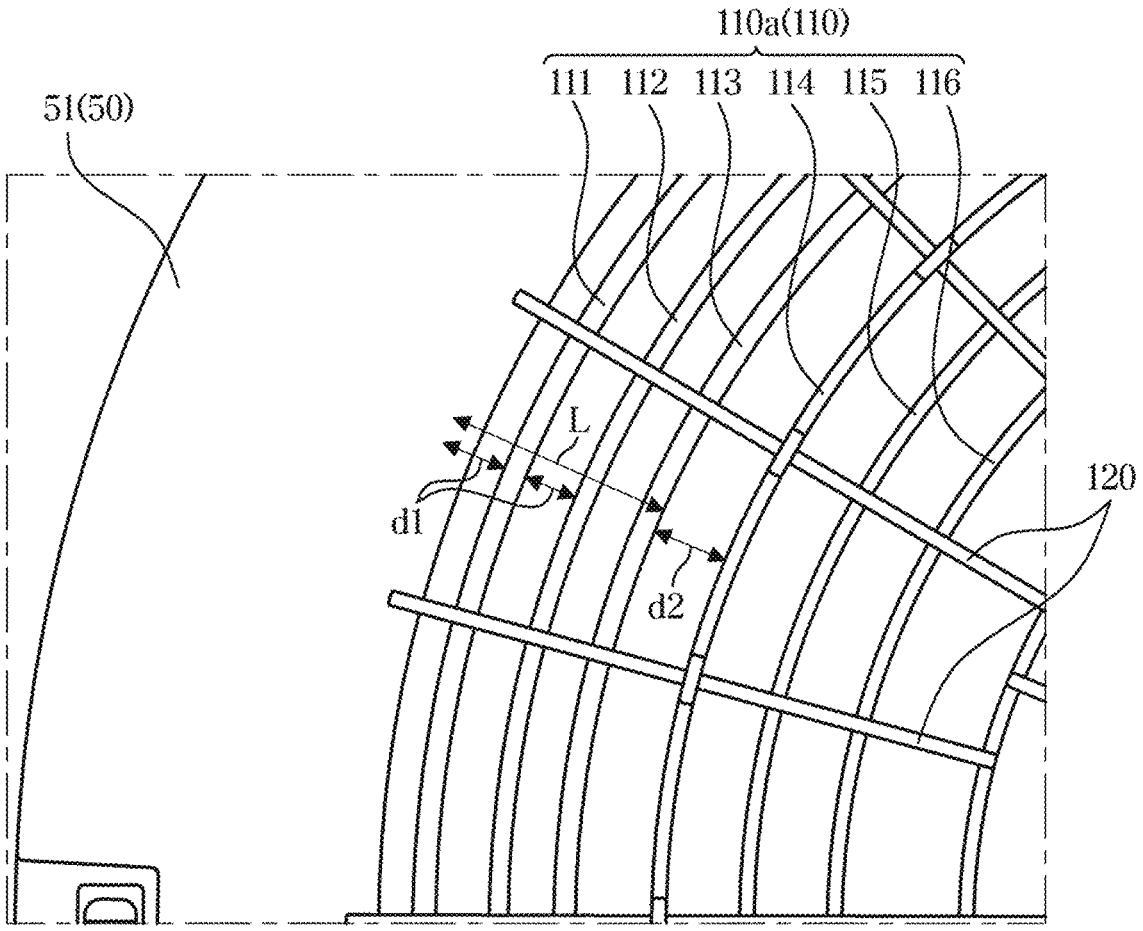
FIG. 7 illustrates a partially enlarged view of the front of the fan guard and the bell mouth of the air conditioner shown in FIG. 4.

FIG. 4 illustrates a front view of the fan guard and the bell mouth of the air conditioner shown in FIG. 1, FIG. 5 illustrates a cross-sectional view taken along the line A-A shown in FIG. 4, FIG. 6 illustrates a cross-sectional view of the fan guard and bell mouth shown in FIG. 5, and FIG. 7 illustrates a partially enlarged view of the front of the fan guard and the bell mouth of the air conditioner shown in FIG. 4.

The fan guard 100 includes a plurality of annular ribs 110 concentrically arranged with a gap from one another from the center C of the fan guard 100 corresponding to the rotation axis X of the blowing fan 20, and a plurality of radial ribs 120 radially extending from the center C of the fan guard 100 to the inner circumferential surface 51 of the bell mouth 50.

The plurality of annular ribs 110 may include a first annular rib 111 adjacent to an outermost edge of the fan guard 100, i.e., closest to the inner circumferential surface 51 of the bell mouth 50.

The plurality of annular ribs 110 may include a first annular rib 111, a second annular rib 112, a third annular rib 113, a fourth annular rib 114, a fifth annular rib 115, and a sixth annular rib 116, sequentially arranged inward within the radius of the fan guard 100.

The fan guard 100 includes a first region 130 adjacent to the circumferential side in the radial direction of the fan guard 100, and a second region 140 located further inside than the first region 140 in the radial direction of the fan guard 100.

The first region 130 is formed outside of a reference circle P arranged within the radius of the fan guard 100 to be centered on the center C of the fan guard 100, and the second region 140 may be formed inside the reference circle P.

Assuming that the radius of the fan guard 100 from the center is R, the radius of the reference circle P may be set to have a length of R*0.6 from the center C of the fan guard 100.

The plurality of annular ribs 110 may be divided into a first group 110*a* arranged in the first region 130 and a second group 110*b* arranged in the second region 140.

The first to sixth annular ribs 111, 112, 113, 114, 115, and 116 may belong to the first group 110*a*. That is, the first to sixth annular ribs 111, 112, 113, 114, 115, and 116 may be arranged in the first region 130.

As described above, the blades 23 of the blowing fan 20 are formed in the annular shape and may be arranged near the rear of the bell mouth 50. Accordingly, the first region 130 of the fan guard 100 may be provided near the blades 23 of the blowing fan 20 to prevent a body part of the user from passing through the first region 130.

Specifically, in the first group 110*a* arranged in the first region 130, the gap between the annular ribs is narrow enough to prevent the users finger or the like from passing through the first region 130.

On the other hand, the second region 140 is arranged relatively far from the blades 23, so that the user may not directly contact the blades 23 of the blowing fan 20 even when a finger of the user passes through the second region 140.

Thus, the second group 110*b* may be formed to have the gap between the annular ribs greater than the gap between the annular ribs of the first group 110*a*. The greater the gap, the less the number of annular ribs arranged, thereby not restricting the air flow.

Accordingly, the gap between the annular ribs in the first group 110*a* adjacent to the blades 23 of the blowing fan 20 may be set to be relatively narrow, and, the gap between the annular ribs in the second group 110*b* arranged away from the blades 23 of the blowing fan 20 may be set to be relatively wide.

As described above, in terms of an amount of air flowing into the blowing fan 20, the amount of air flowing in along the inner circumferential surface 51 of the bell mouth 50 is large due to the blades 23, so the amount of air passing through the first region 130 may be greater than the amount of air passing through the second region 140.

Accordingly, noise and blowing efficiency degradation caused by the first group 110*a* may be greater than those by the second group 110*b*.

In order to solve this problem, at least some of the plurality of annular ribs 110 belonging to the first group 110*a* may be arranged to be inclined from the rotation axis X of the blowing fan 20.

Specifically, at least some of the plurality of annular ribs 110 may be arranged to be inclined in a direction substantially corresponding to the direction of a tangent line t to the inner circumferential surface 50 of the bell mouth 50 at a point in the same line passing the plurality of annular ribs 110 in the radial direction of the fan guard 100.

As described above, because the air flowing into the blowing fan 20 flows in along the inner circumferential surface 51 of the bell mouth 50, the air may flow in the direction of the tangent line t to the inner circumferential surface 51.

The annular ribs of the first group 110*a* arranged in the first region 130 may be directed substantially in the direction of the tangent line t to the inner circumferential surface 51 to minimize resistance of the air. Accordingly, flow of the air flowing into the blowing fan 20 is not restricted, thereby reducing the noise and improving the blowing efficiency. Specifically, assuming that an inclination angle between the rotation axis X of the blowing fan 20 and the tangent line t to the inner circumferential surface 51 of the bell mouth 50 at a point in a same plane passing the first annular rib 211 in the radial direction of the fan guard 100 is $\theta 0$, and an inclination angle of the first annular rib 211 to the direction of the rotation axis X of the blowing fan 20 is $\theta 1$, the inclination angle $\theta 1$ of the first annular rib 211 may be set to satisfy $\theta 0\text{-}20° \leq \theta 1 \leq \theta 0+20°$.

Assuming that inclination angles between the rotation axis X of the blowing fan 20 and the second to sixth annular ribs 112, 113, 114, 115, and 116 are $\theta 2$, $\theta 3$, $\theta 4$, $\theta 5$, and $\theta 6$, respectively, the inclination angles $\theta 1$, $\theta 2$, $\theta 3$, $\theta 4$, $\theta 5$, and $\theta 6$ of the first to sixth annular ribs 111, 113, 114, 115, and 116 may be set to be gradually smaller the further inside the annular lib is in the radial direction of the fan guard 100.

Specifically, the inclination angles $\theta 2$, $\theta 3$, $\theta 4$, $\theta 5$, and $\theta 6$ of the second to sixth annular ribs 112, 113, 114, 115, and 116 may be set to satisfy $0.5*\theta n-1 \leq \theta n \leq 0.95*\theta n-1$.

As such, the reason that the inclination angles $\theta 1$, $\theta 2$, $\theta 3$, $\theta 4$, $\theta 5$ and $\theta 6$ of the first to sixth annular ribs 111, 113, 114, 115 and 116 become gradually smaller the annual rib is in the radial direction of the fan guard 100 is because the air flowing into the blowing fan 20 passes through the fan guard 100 in parallel with the direction of the rotation axis X of the blowing fan 20 as the air is directed to the center C of the fan guard 100.

Accordingly, disturbance to the flow of air may be minimized in each region of each fan guard 100. For example, the annular ribs of the first group 110*a* may be arranged to be inclined in a direction substantially corresponding to the tangent line t to the inner circumferential surface 51 of the bell mouth 50, and toward the center C of the fan guard 100, the inclination angles $\theta 1$, $\theta 2$, $\theta 3$, $\theta 4$, $\theta 5$, and $\theta 6$ may be gradually, and the annular ribs of the second group 110*b* may be arranged in a direction corresponding to the direction of the rotation axis X of the blowing fan 20.

In other words, the plurality of annular ribs 110 of the fan guard 100 may be arranged to extend in a direction corresponding to an inflow direction I in which air flows, so that the flow of air may not be inhibited as much as possible.

As described above, in the second group 110*b*, the gap between annular ribs may be greater than the gap between annular ribs of the first group 110*a*.

In addition, even the gaps among the annular ribs of the first group 110*a* may be set to be different.

Specifically, as described above, the blades 23 of the blowing fan 20 are arranged adjacent to the inner circumferential surface 51 of the bell mouth 50, and thus distance d1 between annular ribs 110*a* adjacent to the circumferential surface 51 of the bell mouth 50 may be smaller than distance d2 between annular ribs 110*a* arranged away from the circumferential surface 51 of the bell mouth 50. This is to further secure the safety of the user.

For example, the distance d1 between the first, second and third annular ribs 111, 112, and 113 adjacent to the inner circumferential surface 51 of the bell mouth 50 may be smaller than the distance d2 between the fourth, fifth and six annular ribs 114, 115, and 116.

For the plurality of annular ribs 110, assuming that thickness in the radial direction of the fan guard 100 of each of the plurality of annular ribs 110 is t, and height of each of the plurality of annular ribs 110 in the direction of the rotation shaft X of the blowing fan 20 is h, the height of each of the plurality of annular ribs 110 may be set to satisfy $h \leq 10t$.

When the thickness t of each of the plurality of annular ribs 110 is set to be greater than or equal to a predetermined thickness, a cross-sectional area in which the air and each of the plurality of annular ribs 110 rub each other may increase noise and may reduce blowing efficiency.

However, the disclosure is not limited thereto, and the thickness and height of each of the plurality of annular ribs 110 may be variously set.

In addition, although the first to the sixth annular ribs 111, 113, 114, 115, and 116 are arranged in the first group 110*a*, the number of the annular ribs arranged in the first group 110*a* is not limited thereto but may vary according to the length of the radius R of the fan guard 100.

Hereinafter, a fan guard 200 of the air conditioner 1 according to another embodiment of the disclosure will be described.

Figure 8:
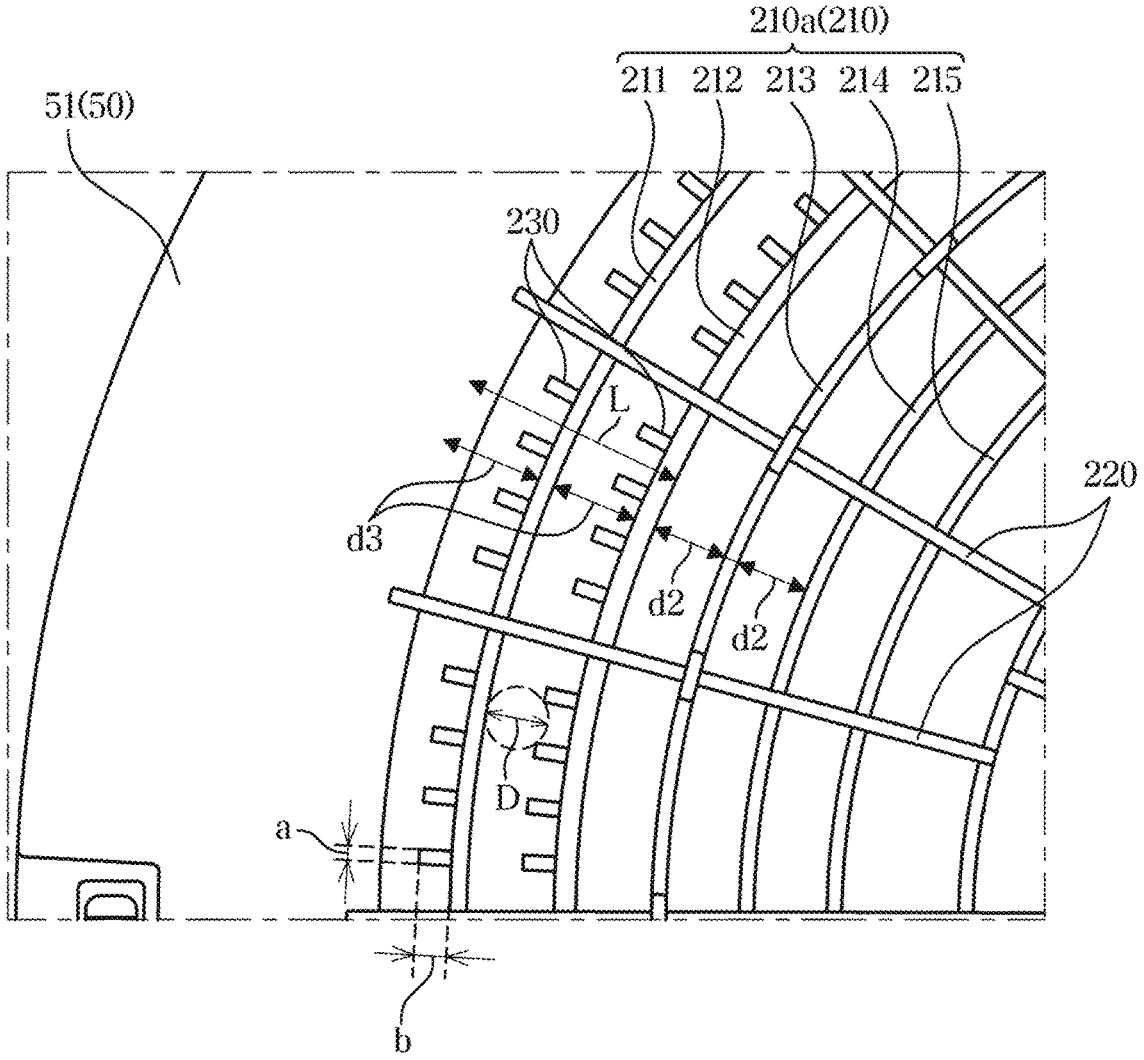
FIG. 8 illustrates a partially enlarged view of the front of a fan guard and a bell mouth of an air conditioner according to another embodiment of the disclosure.
Figure 9:
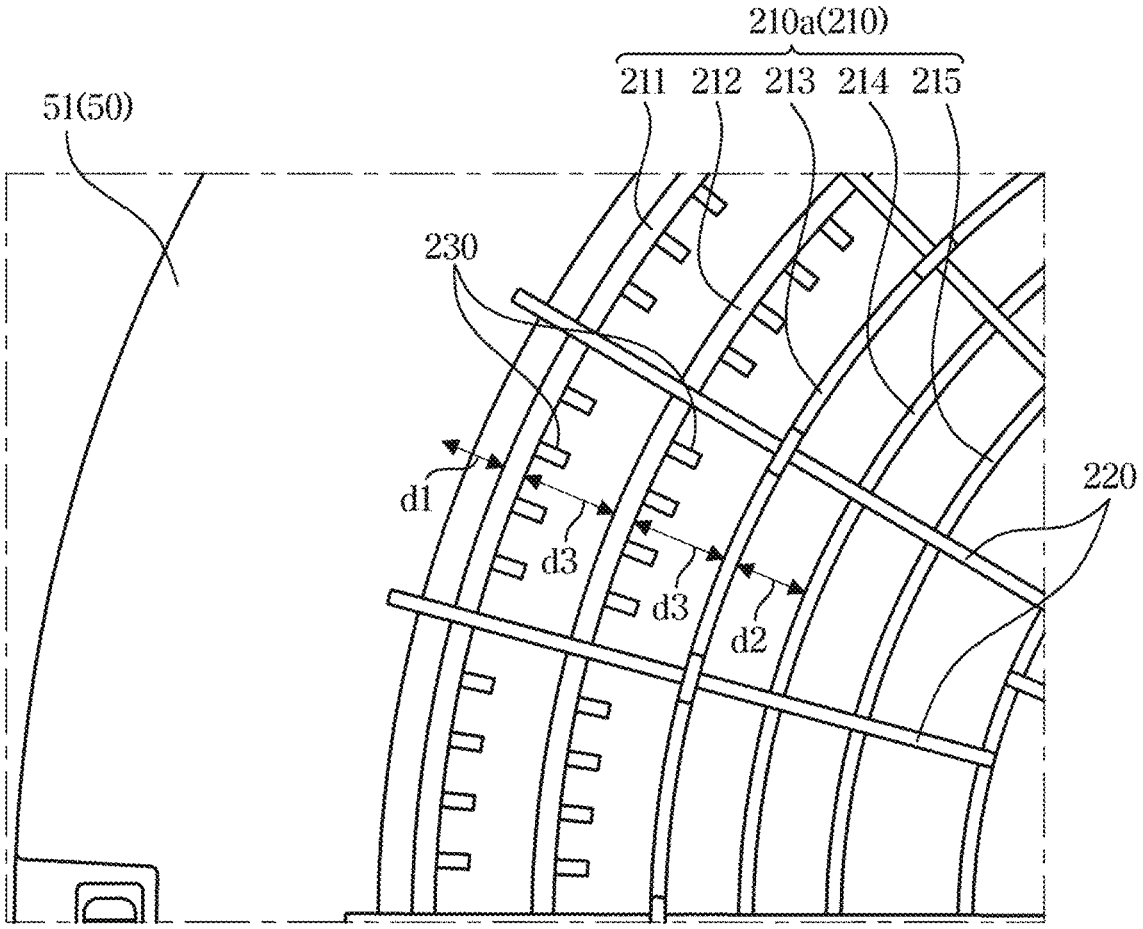
FIG. 9 illustrates a partially enlarged view of the front of a fan guard and a bell mouth of an air conditioner according to another embodiment of the disclosure.
Figure 10:
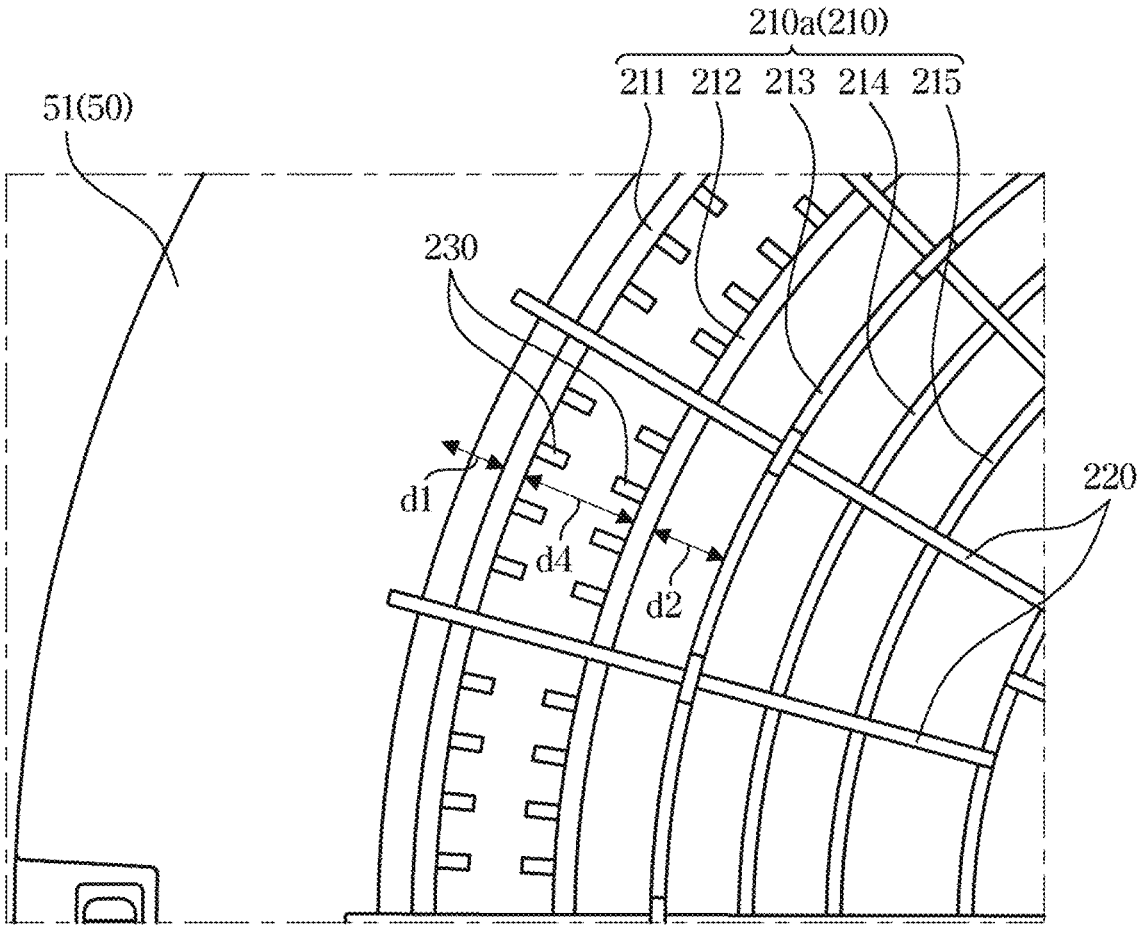
FIG. 10 illustrates a partially enlarged view of the front of a fan guard and a bell mouth of an air conditioner according to another embodiment of the disclosure.

FIG. 8 illustrates a partially enlarged view of the front of a fan guard and a bell mouth of an air conditioner, according to another embodiment of the disclosure, FIG. 9 illustrates a partially enlarged view of the front of a fan guard and a bell mouth of an air conditioner according to another embodiment of the disclosure, and FIG. 10 illustrates a partially enlarged view of the front of a fan guard and a bell mouth of an air conditioner according to another embodiment of the disclosure.

As described above, since the blades 23 of the blowing fan 20 are arranged adjacent to the inner circumferential surface 51 of the bell mouth 50, the amount of air flowing in along the inner circumferential surface 51 is large.

In addition, in order to secure the safety of the user, the distance d1 between the annular ribs 110*a* in the region adjacent to the inner circumferential surface 51 of the bell mouth 50 is narrowly set, so a large number of annular ribs 110*a* may be provided in the region adjacent to the inner circumferential surface 51 of the bell mouth 50.

Accordingly, although the restriction on the flow of air is minimized in the region adjacent to the inner circumferential surface 51 of the bell mouth 50, the cross-sectional area of the annular ribs 110*a* that comes into contact with air increases, leading to an increase in noise and degradation of blowing efficiency.

In order to solve this problem, the fan guard 200 of the air conditioner 1 according to another embodiment of the disclosure may include at least some of a plurality of annular ribs 210*a* adjacent to the inner circumferential surface 51 of the bell mouth 50 may include a plurality of protruding ribs 230 protruding radially from at least one of the outer circumferential surface or the inner circumferential surface of the annual rib.

Specifically, as shown in FIG. 8, a first annular rib 211 arranged closest to the inner circumferential surface 51 of the bell mouth 50 and a second annular rib 212 arranged further inside than the first annular rib 211 in the radial direction of the fan guard 200 may include a plurality of protruding ribs 230.

The plurality of protruding ribs 230 may protrude in the radial direction of the fan guard 200 from the outer circumferential surface of each of the first annular rib 211 and the second annular rib 212.

A distance d3 between the first annular rib 211 and the second annular rib 212 due to the plurality of protruding ribs 230 may be set to be larger than the distance d1 between the first annular rib 211 and the second annular rib 112 of the fan guard 100 according to the previous embodiment of the disclosure.

Due to height b of the plurality of protruding ribs 230 protruding from the second annular rib 212 toward the first annular rib 211, a minimum distance for securing safety of the user between the plurality of annular ribs 210*a* is ensured, so the distance d3 between the second annular rib 212 and the first annular rib 211 may be set to be larger than the distance d1 between the first annular rib 211 and the second annular rib 112 of the fan guard 100 according to the previous embodiment of the disclosure.

Accordingly, assuming that a predetermined distance from a point on the inner circumferential surface 51 of the bell mouth 50 in a line passing the first annular rib 211 in the radial direction of the fan guard 200 to a point of the line further inside in the radial direction of the fan guard 200 is L, the first annular rib 211 and the second annular rib 212 are arranged within the distance L in the fan guard 200 according to the embodiment of the disclosure.

In this regard, for the fan guard 100 according to the previous embodiment of the disclosure, the first annular rib 211, the second annular rib 112 and the third annular rib 113 may be arranged within the distance L, because the distance d1 between the plurality of annular ribs 110*a* is narrow.

An area formed within the distance L from the inner circumferential surface 51 of the bell mouth 50 is one having the largest amount of air that flows into the blowing fan 20, which is also nearest to the blades 23, where the distance L may vary depending on the size of the blades 23 or the diameter of the fan guards 100 and 200.

Therefore, the total number of annular ribs 210*a* of the fan guard 200, which are located adjacent to the inner circumferential surface 51 of the bell mouth 50, may be smaller than the total number of annular ribs 110*a* of the fan guard 100, which are located adjacent to the inner circumferential surface 51 of the bell mouth 50.

Accordingly, the fan guard 200 according to this embodiment of the disclosure may reduce the noise more than the fan guard 100 according to the previous embodiment of the disclosure, and improve the blowing efficiency.

The distance d3 between the second annular rib 212 and the first annular rib 211 may be set to be equal to or greater than the distance d2 between second annular rib 212 and the third annular rib 213 or the third annular rib 213 and the fourth annular rib 214.

Assuming that thickness of each the plurality of protruding ribs 230 in the circumferential direction of the fan guard 200 is a, the thickness a of each of the plurality of protruding ribs 230 may satisfy $1\ mm \leq a \leq 5\ mm$.

This is because when the thickness of each of the plurality of protruding ribs 230 is set to be too thick, a cross-sectional area of the fan guard 200 in contact with air increases, causing degradation of the blowing efficiency and increasing noise.

The height b of each of the plurality of protruding ribs 230 may be set to satisfy $1\ mm \leq b \leq 10\ mm$. This is because when the thickness of each of the plurality of protruding ribs 230 is too thick, a cross-sectional area of the fan guard 200 that comes into contact with air increases, causing degradation of the blowing efficiency and increasing noise.

Assuming that the diameter of an inscribed circle formed between any two of the plurality of protruding ribs 230 protruding from the first annular rib 211 and the second annular rib 212 is D, the diameter of the inscribed circle may be set to satisfy 5.6 mm≤D≤8.6 mm.

The reason for limiting the diameter D of the inscribed circle to a certain length is to prevent the users finger as small as the finger of young children from passing through the fan guard 200 and simultaneously prevent an increase of a cross-section of the fan guard 200, which causes degradation of blowing efficiency and increasing noise.

As shown in FIG. 9, the plurality of protruding ribs 230 may be provided to protrude in the radial direction of the fan guard 200 from the inner circumferential surfaces of the first annular rib 211 and the second annular rib 212.

Accordingly, the distance d1 between the first annular rib 211 and the inner circumferential surface 51 may be set to be equal to the distance d1 between the first annular rib 211 and the inner circumferential surface 51 according to the previous embodiment of the disclosure.

However, due to the plurality of protruding ribs 230 protruding from the first annular rib 211 between the first annular rib 211 and the second annular rib 212, the distance d3 between the first annular rib 211 and the second annular rib 212 may be greater than the distance d1 between the first annular rib 211 and the inner circumferential surface 51.

Furthermore, due to the plurality of protruding ribs 230 protruding from the second annular rib 212 between the second annular rib 212 and the third annular rib 213, the distance d3 between the second annular rib 212 and the third annular rib 213 may be greater than the distance d1 between the first annular rib 211 and the inner circumferential surface 51 and the distance d3 may be set to be equal to or greater than the distance d2 between the third annular rib 213 and the fourth annular rib 214.

As shown in FIG. 10, the plurality of protruding ribs 230 may protrude from the inner circumferential surface of the first annular rib 211 and the outer circumferential surface of the second annular rib 212 in the radial direction of the fan guard 200.

Accordingly, the distance d1 between the first annular rib 211 to the inner circumferential surface 51 may be set to be equal to the distance d1 between the first annular rib 211 and the inner circumferential surface 51 according to the previous embodiment of the disclosure.

However, due to the plurality of protruding ribs 230 protruding from the first annular rib 211 between the first annular rib 211 and the second annular rib 212, the distance d4 between the first annular rib 211 and the second annular rib 212 may be greater than the distance d1 between the first annular rib 211 to the inner circumferential surface 51, and may be greater than or equal to the distance d2 between the third annular rib 213 and the second annular rib 212.

Hereinafter, a fan guard 300 of the air conditioner 1 according to another embodiment of the disclosure will be described.

Figure 11:
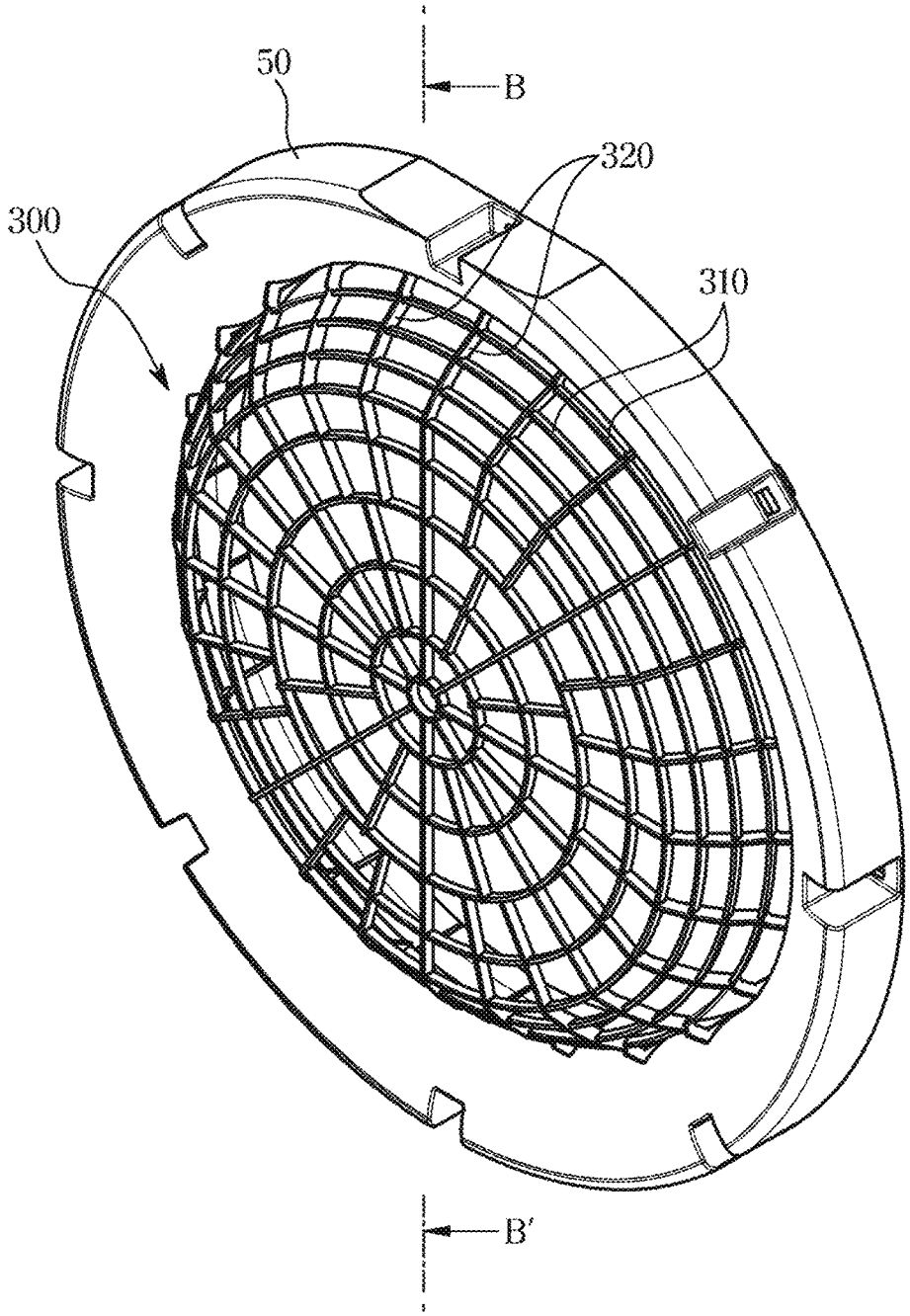
FIG. 11 illustrates a perspective view of the front of a fan guard and a bell mouth of an air conditioner according to another embodiment of the disclosure.
Figure 12:
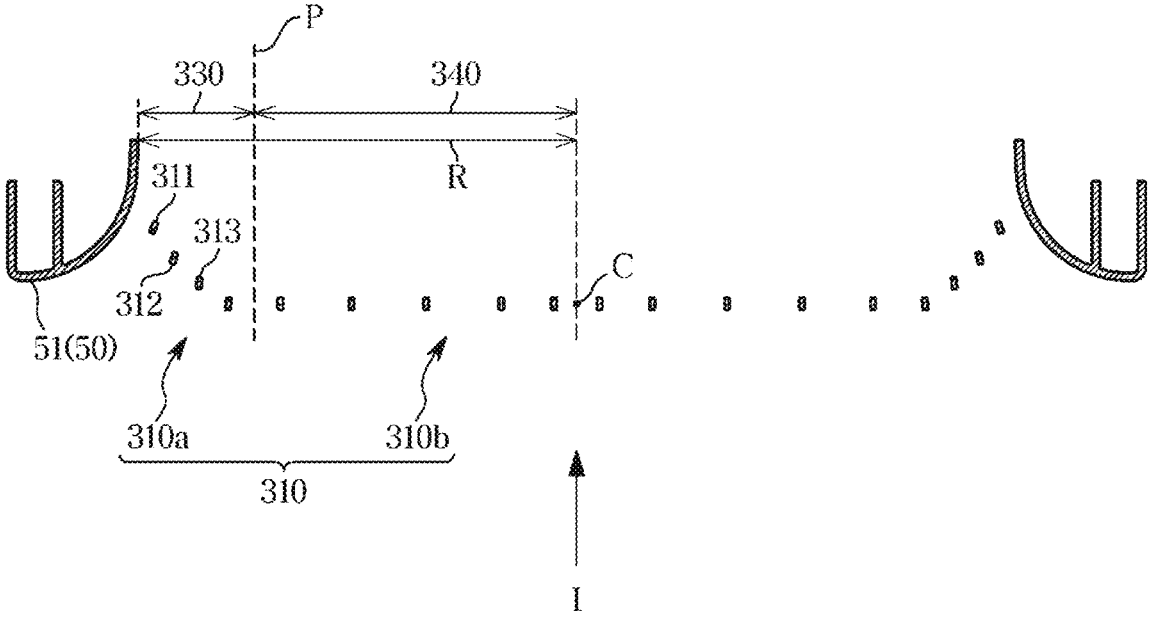
FIG. 12 illustrates a cross-sectional view taken along the line B-B shown in FIG. 11.

FIG. 11 illustrates a perspective view of the front of a fan guard and a bell mouth of an air conditioner according to another embodiment of the disclosure, and FIG. 12 illustrates a cross-sectional view taken along the line B-B shown in FIG. 11.

The plurality of annular ribs 110 and 210 of the fan guards 100 and 200 according to the previous embodiments of the disclosure may be arranged on the same plane orthogonal to the rotation axis X On the other hand, in this embodiment of the disclosure, at least some of a plurality of annular ribs 310 of the fan guard 300 may be provided to protrude to the front of the air conditioner 1.

Specifically, the fan guard 300 may be divided into a first region 330 adjacent to the circumferential side in the radial direction of the fan guard 300 and a second region 340 located further inside than the first region 330 in the radial direction of the fan guard 300 and adjacent to the center C of the fan guard 300. The first region 330 may extend to the front of the air conditioner 1 at an angle with the rotation axis X, and the second region 340 may extend inward from the first region 330 in the radial direction of the fan guard 300, which is orthogonal to the rotation axis X.

The fan guard 300 may be arranged relatively forward from the bell mouth 50 as compared with the fan guards 100 and 200 according to the previous embodiments.

Accordingly, the fan guard 300 may be far from the blades 23, further securing safety even when a body part of the user passes through the fan guard 40.

As a result, the distance between the plurality of annular ribs 310 of the fan guard 300 of the embodiment may be set to be relatively larger than the distance between the plurality of annular ribs 110 and 210 of the fan guards 100 and 200 in the previous embodiments of the disclosure.

This may lead to a reduction in cross section of the fan guard 300 that comes into contact with air, and an increase in blowing efficiency of the air conditioner 1.

In particular, the number of annular ribs of the first group 310*a* arranged in the first region 330 may be reduced, so that the air blowing efficiency of the air conditioner 1 may increase and noise may be reduced.

In addition, as described above, as the first region 330 is inclined, a range of the inclination angle of the annular ribs of the first group 310*a* may be set to be wider than the range of the inclination angle of the annular ribs of the first groups 110*a* and 210*a* of the fan guards 100 and 200 according to the previous embodiments of the disclosure.

For the annular ribs of the first group 310*a*, the second annular rib 312 is arranged further forward than the first annular rib 311 and inclined to the direction of the rotation axis X.

Further, the third annular rib 313 is arranged further forward than the second annular rib 312, and inclined to the direction of the rotation axis X. That is, the first, second, and third annular ribs 311, 312, and 313 may be sequentially inclined forward to the rotational axis X toward the front.

With this arrangement, the first, second, third annular ribs 311, 312, 313 and the annular ribs of the first group 310*a* may be arranged in a direction substantially opposite the direction of the incoming air (the thickness section of the annular rib faces the incoming air).

Therefore, the resistance of the incoming air may be reduced more than with the annular ribs of the first groups 110*a* and 210*a* of the fan guards 100 and 200 according to the previous embodiment of the disclosure, and thus the range of the inclination angle of the annular ribs of the first group 310*a* may be wider than that of the annular ribs of the first groups 110*a* and 210*a* of the fan guards 100 and 200 according to the previous embodiments of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. An air conditioner, comprising:

a blowing fan including an inlet;

a bell mouth formed along a circumferential direction of the inlet; and a fan guard extending from an inner circumferential surface of the bell mouth and covering the inlet;

wherein the fan guard comprises a plurality of annular ribs concentrically arranged with a gap from a center of the fan guard corresponding to a rotation axis of the blowing fan, wherein the plurality of annular ribs comprises a first annular rib adjacent to an outermost edge of the fan guard and a second annular rib arranged further inside than the first annular rib in a radial direction of the fan guard, wherein the first annular rib is arranged to be inclined to a direction of the rotation axis in a direction corresponding to a tangent line of the bell mouth, wherein a gap between the first annular rib and the second annular rib is set to be narrower than a gap between any annular ribs arranged adjacent to the center of the fan guard, and wherein assuming that an inclination angle between a tangent line to the inner circumferential surface of the bell mouth at a point in a same plane passing the first annular rib in the radial direction of the fan guard and the rotation axis is $\theta 0$ and an inclination angle of the first annular rib to the rotation axis is $\theta 1$, the inclination angle $\theta 1$ of the first annular rib is set to satisfy $\theta 0-20° \leq \theta 1 \leq \theta 0+20°$.

2. The air conditioner according to claim 1, wherein:

some of the plurality of annular ribs, arranged in a first region adjacent to the bell mouth and including the first annular rib and the second annular rib are arranged to be inclined to the direction of the rotation axis, and some others of the plurality of annular ribs, arranged in a second region adjacent to the center of the fan guard are arranged to correspond to the direction of the rotation axis.

3. The air conditioner according to claim 2, wherein assuming that a radius from the center of the fan guard is R, the first region is arranged outside a circle with radius R*0.6 in the radial direction of the fan guard.

4. The air conditioner according to claim 2, wherein:

the first region is formed to be inclined to a front of the inlet with respect to the rotation axis, and the second region extends from the first region and is formed to be orthogonal to the rotation axis in front of the inlet.

5. The air conditioner according to claim 1, wherein the inclination angle of the first annular rib to the rotation axis is set to be larger than an inclination angle of the second annular rib to the rotation axis.

6. The air conditioner according to claim 5, wherein:

the plurality of annular ribs further include a third annular rib arranged further inside than the second annular rib in the radial direction of the fan guard, and the inclination angle of the first annular rib to the rotation axis, the inclination angle of the second annular rib to the rotation axis, and an inclination angle of the third annular rib to the rotation axis are set to be gradually smaller.

7. The air conditioner according to claim 5, wherein assuming that the inclination angle of the first annular rib is 01 and the inclination angle of the second annular rib is $\theta 2$, the inclination angle of the second annular rib $\theta 2$ is set to satisfy $0.5*\theta 1 \leq \theta 2 \leq 0.95*\theta 1$.

8. The air conditioner according to claim 1, wherein the first annular rib comprises a plurality of protruding ribs projecting radially from at least one of an outer circumferential surface or an inner circumferential surface of the first annular rib.

9. The air conditioner according to claim 8, wherein:

the plurality of annular ribs further comprises the second annular rib arranged further inside than the first annular rib in the radial direction of the fan guard, and the second annular rib further comprises a plurality of protruding ribs projecting radially from at least one of an outer circumferential surface or an inner circumferential surface of the second annular rib.

10. The air conditioner according to claim 9, wherein assuming that a diameter D is a diameter of an inscribed circle contacting between the inner circumferential surface of the first annular rib and any two of the plurality of protruding ribs of the second annular rib, the diameter D of the inscribed circle is set to satisfy 5.6 mm≤D≤8.6 mm.

11. The air conditioner according to claim 8, wherein assuming that a thickness of each of the plurality of protruding ribs in the circumferential direction of the fan guard is a, the thickness of each of the plurality of protruding ribs is provided to satisfy 1 mm≤a≤5 mm.

12. The air conditioner according to claim 11, wherein assuming that a height of each of the plurality of protruding ribs in the radial direction of the fan guard is b, the height of each of the plurality of protruding ribs is set to satisfy 1 mm≤b≤10 mm.

13. The air conditioner according to claim 1, wherein assuming that a thickness of each of the plurality of annular ribs in the radial direction of the fan guard is t and a height of each of the plurality of annular ribs in the rotating axis is h, the height of each of the plurality of annular ribs is set to satisfy h≤10t.

14. The air conditioner according to claim 1, wherein the blowing fan comprises a sirocco fan.

15. An air conditioner, comprising:

a blowing fan including an inlet;

a bell mouth formed along a circumferential direction of the inlet; and a fan guard extending from an inner circumferential surface of the bell mouth and covering the inlet;

wherein the fan guard comprises a plurality of annular ribs concentrically arranged with a gap from a center of the fan guard corresponding to a rotation axis of the blowing fan, wherein some of the plurality of annular ribs arranged in a first region adjacent to the bell mouth are arranged to be inclined to the rotation axis, and some others of the plurality of annular ribs arranged in a second region adjacent to the center are arranged to correspond to the rotation axis, wherein a gap between some of the annular ribs arranged in the first region is narrower than a gap between some other annular ribs arranged in the second region, and wherein assuming that an inclination angle between a tangent line to the inner circumferential surface of the bell mouth at a point in a same plane passing a first annular rib in a radial direction of the fan guard and the rotation axis is $\theta 0$ and an inclination angle of the first annular rib to the rotation axis is $\theta 0$, the inclination angle $\theta 1$ of the first annular rib is set to satisfy $\theta 0-20° \leq \theta 1 \leq \theta 0+20°$.

16. The air conditioner according to claim 15, wherein an inclined angle of each of the annular ribs arranged in the first region adjacent to the bell mouth to the rotation axis is set to become smaller as an annular rib is arranged further inside in the radial direction of the fan guard.

17. The air conditioner according to claim 15, wherein:

the plurality of annular ribs comprises the first annular rib adjacent an outermost edge of the fan guard and a second annular rib arranged further inside than the first annular rib in the radial direction of the fan guard, and assuming that the inclination angle of the first annular rib is $\theta 1$ and an inclination angle of the second annular rib is $\theta 2$, the inclination angle of the second annular rib $\theta 2$ is set to satisfy $0.5*\theta 1 \leq \theta 2 \leq 0.95*\theta 1$.

18. An air conditioner, comprising:

a blowing fan including an inlet;

a bell mouth formed along a circumferential direction of the inlet; and a fan guard extending from an inner circumferential surface of the bell mouth and covering the inlet, wherein the fan guard comprises a plurality of annular ribs concentrically arranged with a gap from a center of the fan guard corresponding to a rotation axis of the blowing fan, wherein the plurality of annular ribs are divided into a first group of annular ribs arranged in a first region adjacent to the bell mouth and a second group of annular ribs arranged in a second region adjacent to the center, wherein at least some of the annular ribs in the first group comprise a plurality of protruding ribs projecting radially from at least one of an outer circumferential surface or an inner circumferential surface of the at least some annular rib, and wherein assuming that an inclination angle between a tangent line to the inner circumferential surface of the bell mouth at a point in a same plane passing a first annular rib in a radial direction of the fan guard and the rotation axis is $\theta 0$ and an inclination angle of the first annular rib to the rotation axis is $\theta 0$, the inclination angle $\theta 1$ of the first annular rib is set to satisfy $\theta 0-20° \leq \theta 1 \leq \theta 0+20°$.

* * * * *